US005964083A

United States Patent [19]

Greis et al.

[11] Patent Number: 5,964,083

[45] Date of Patent: Oct. 12, 1999

[54] METHOD FOR PRODUCING A TWISTED YARN IN A COMBINED SPINNING AND TWISTING PROCESS

[75] Inventors: Roland Greis, Tönisvorst; Georg Heinen, Inden; Jürgen Schnitzler, Mönchengladbach; Bertram Schwanitz, Kempen, all of Germany

[73] Assignee: Volkmann GmbH & Co., Krefeld, Germany

[21] Appl. No.: 09/042,901

[22] Filed: Mar. 16, 1998

[30] Foreign Application Priority Data

Mar. 15, 1997 [EP] European Pat. Off. ..... 971044821

[51] Int. Cl.[6] ..... D01H 4/00

[52] U.S. Cl. ..... 57/400; 57/406; 57/408; 57/409; 57/58.65; 57/58.67

[58] Field of Search ..... 57/400, 58.65, 57/406, 408, 409, 58.67

[56] References Cited

U.S. PATENT DOCUMENTS

| | | | |
|---|---|---|---|
| 3,368,336 | 2/1968 | Franzen | 57/58.67 |
| 3,530,658 | 9/1970 | Johnson | 57/58.67 |

FOREIGN PATENT DOCUMENTS

| | | |
|---|---|---|
| 1098861 | 4/1957 | Germany . |
| 1292555 | 3/1966 | Germany . |
| 1560260 | 7/1966 | Germany . |
| 78710 | 8/1969 | Germany . |
| 88001 | 11/1972 | Germany . |
| 4331801 | 9/1993 | Germany . |
| 4430917 | 8/1994 | Germany . |
| 44 30 917 | 9/1995 | Germany . |
| 5910652 | 12/1982 | Japan . |

*Primary Examiner*—William Stryjewski
*Assistant Examiner*—Gina Silverio
*Attorney, Agent, or Firm*—Robert W. Becker & Associates

[57] ABSTRACT

A method for manufacturing a twisted yarn by a combined spinning and twisting process includes the steps of producing in at least two spinning devices individual spun yarns and guiding the spun yarns together to a first centering location positioned coaxially to the axis of the double twisting device to subject the individual spun yarns in a first yarn feeding direction to a first twist, whereby a yarn balloon is formed. Subsequently, the spun yarns are guided to a second centering location, also positioned coaxially to the axis of the double twisting device, and through the second centering location into the interior of the yarn balloon to subject the spun yarns in a second yarn feeding direction, opposite the first yarn feeding direction, to a second twist. The spun yarns are then wound onto a rotating bobbin positioned in the interior of the yarn balloon.

2 Claims, 3 Drawing Sheets

METHOD FOR PRODUCING A TWISTED YARN IN A COMBINED SPINNING AND TWISTING PROCESS

BACKGROUND OF THE INVENTION

In a method disclosed in German Patent 43 31 801 for manufacturing a twisted yarn in an integrated spinning and twisting process, two spinning devices are used for producing two spun yarns which spinning devices are in the form of an open end spinning rotor within a double twist device, which serves to twist the two spun yarns generated by the spinning devices according to the double twist principle. In this known method, respectively, the corresponding known device the loose fiber material is guided to the spinning devices through an envelope surface defined by the yarn balloon. Due to the integration of the spinning devices into the twisting device, the spinning devices in respect to their dimensions, especially their diameter, are subject to constructive limits. The known integrated spinning and twisting process is thus suitable only to a limited extent for processing worsted or combed yarns because worsted yarns, in general, have a fiber length of between 120 to 160 mm which requires spinning rotors with a correspondingly large diameter. In the know system it is also possible that complications occur with respect to guiding fibers of great staple fiber length through the yarn balloon.

From East German patent documents 78 710 a method for producing a twisted yarn according to the open end method is known; however, there is no disclosure in regard to what kind of method steps must be performed in order to twist the spun yarns produced in the open end spinning rotors.

It is therefore an object of the present invention to provide a combined spinning and twisting method which is especially suitable also for processing worsted yarn of great staple fiber length.

SUMMARY OF THE INVENTION

The inventive method for manufacturing a twisted yarn by a combined spinning and twisting process is primarily characterized by;

a) Producing in at least two spinning devices individual spun yarns;

b) Guiding the spun yarns together to a first centering location positioned coaxially to the axis of a double twisting device to subject the individual spun yarns in a first yarn feeding direction to a first twist, whereby a yarn balloon is formed;

c) Subsequently guiding the spun yarns to a second centering location, also positioned coaxially to the axis of the double twisting device, and through the second centering location into the interior of the yarn balloon to subject the spun yarns in a second yarn feeding direction, opposite the first yarn feeding direction, to a second twist;

d) Winding the spun yarns onto a rotating bobbin positioned in the interior of the yarn balloon.

Advantageously, the step b) includes introducing the spun yarns into a hollow spindle forming the first centering location, wherein the spun yarns, after leaving the hollow spindle, enter centrally a yarn storage disc of a spindle rotor of the double twisting device and exit radially outwardly the yarn storage disc to form the yarn balloon in the first feeding direction.

In another embodiment of the present invention, the step b) includes passing the spun yarns through a yarn guide eye forming the first centering location and located above the double twisting device, wherein the spun yarns, after leaving the yarn guide eye, forms the yarn balloon rotating about the double twisting device. The step c) includes passing the spun yarns radially inwardly into the yarn storage disc of a spindle rotor, and in the second feeding direction into the hollow spindle of the spindle rotor forming the second centering location.

Preferably, the spinning devices are open end spinning rotors.

The method may further include the step of supporting the spinning devices in a common rotor having a hollow feed axle and the step of feeding fiber material to be spun through the hollow feed axle and feed tubes connected to the hollow feed axle to the spinning devices.

According to the present invention, the system for producing the two spun yarns is positioned external to the two-for-one twisting device which cooperates itself with a so-called inner winding device whereby the winding bobbin and the winding device are positioned within the two-for-one twisting device and thus within the yarn balloon that is produced during operation of the twisting device.

Two-for-one twisting devices with inner winding devices are known from German Patents 1 093 861 and 1 292 555.

BRIEF DESCRIPTION OF THE DRAWINGS

The object and advantages of the present invention will appear more clearly from the following specification in conjunction with the accompanying drawings, in which.

DESCRIPTION OF PREFERRED EMBODIMENTS

The present invention will now be described in detail with the aid of several specific embodiments utilizing FIGS. 1 through 4.

Figure 1:
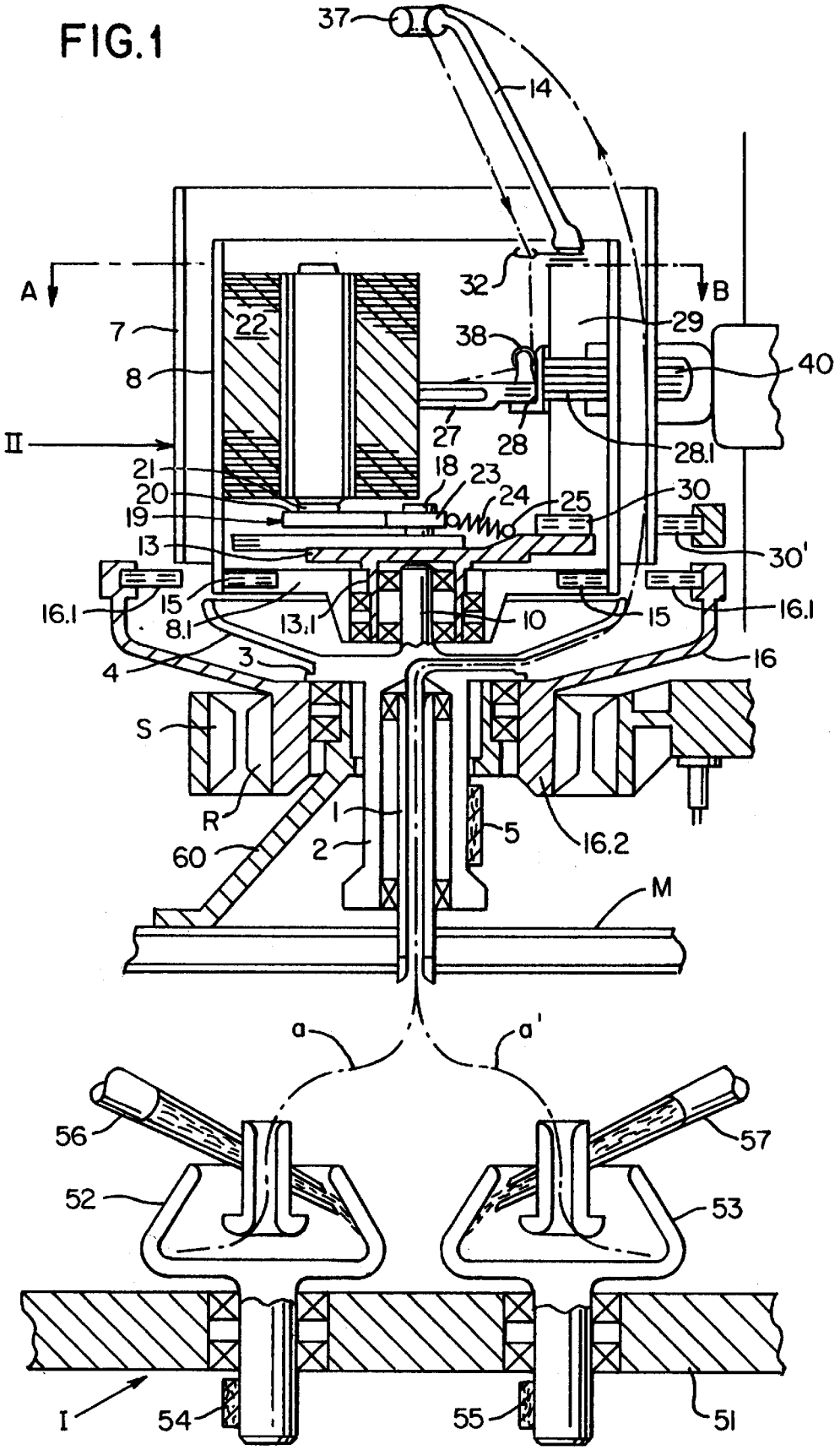
FIG. 1 shows a schematic representation of a section of the first embodiment of the inventive spinning and twisting device.

The spinning and twisting device represented in FIG. 1 compromises a spinning portion I and a twisting portion II operating according to the two-for-one principle (double twisting principle).

The spinning portion I contains at least two adjacently arranged open end spinning rotors 52,53 supported in a machine frame 51 which are rotatably driven in a suitable manner, for example, by tangential drive belts 54, 55. Fiber material feed tubes 56, 57 open respectively in a conventional manner into the open end spinning rotors 52-53.

The two-for-one twisting device II coordinated with the spinning device I comprises a machine frame M having stationarily supported thereat a hollow axle 1 on which the driven hollow whorl 2 is rotatably supported and driven by a tangential drive belt 5. The hollow whorl 2 together with the yarn storage disc 3, the overflow plate 4, and the axle pin 10 forms the spindle rotor.

The support 13 having a bearing bushing 13.1 is supported on the axle pin 10 and supports a yarn winding device in a rotatable manner which will be described in the following. A protective pot 8 with a pot bottom 8.1 is rotatably supported on the bearing bushing 13.1 and surrounds the balloon limiter 7. The pot bottom 8.1 has distributed about its circumference alternatingly polarized magnetic poles 15. Counter magnets 16.1 arranged at a starwheel 16 (see FIG. 3) cooperate with the magnetic poles 15. The star wheel 16 is rotatably supported by a hub 16.2 on a bearing block 60 which is fastened to the machine frame M. The star wheel 16 is driven by a conventional electromotonic drive which is represented only schematically as a rotor part R and a stator part S which is supplied in a suitable manner with electric current. When the star wheel 16 rotates, the protective pot 8 and the protective pot bottom 8.1 are rotated also.

A two-armed pivot bracket 19 is eccentrically supported by a pin 18 (FIG. 2) on the winding bobbin support 13, preferably embodied as a circular disc and secured against rotation by magnets 30, 30'. One lever arm 20 of the bracket 19 has a receiving pin 21 for the winding bobbin 22. The shorter, oppositely arranged lever arm 23 is engaged by a schematically shown spring 24, the other end of which is connected at the location 25 to the winding bobbin support 13. The spring 24 serves to press the winding bobbin 22 against the inner mantle of the cylindrical protective pot 8 so that, when the protective pot 8 rotates, the winding bobbin 22 is also driven in rotation.

The winding device also includes a traversing yarn guide 27 which is connected to a magnet holder 28 having arranged thereat the magnet 28.1. The magnet support 28 glides in a track 29 which is fastened to the winding bobbin support 13 and extends parallel to the axis of the spindle. At the upper end of the track 29 the support arm 32 that is slanted inwardly toward to the spindle axis is pivotally attached and supports a yarn guide eye 37 positioned coaxially to the spindle axis.

The traversing yarn guide 27 is reciprocated by a counter magnet 40 positioned external to the balloon limiter 7 and moveable in the upward and downward direction. The counter magnet 40 thus entrains in a reciprocating fashion the magnet holder 28 along the track 29 and thus also the traversing yarn guide 27.

At the upper end of the track 29 a further yarn guide 32 is arranged which is positioned vertically above a guide roller 38 which is coordinated with the traversing yarn guide 27 that rests, loaded by a spring, at the mantle surface of the winding bobbin 22.

Figure 2:
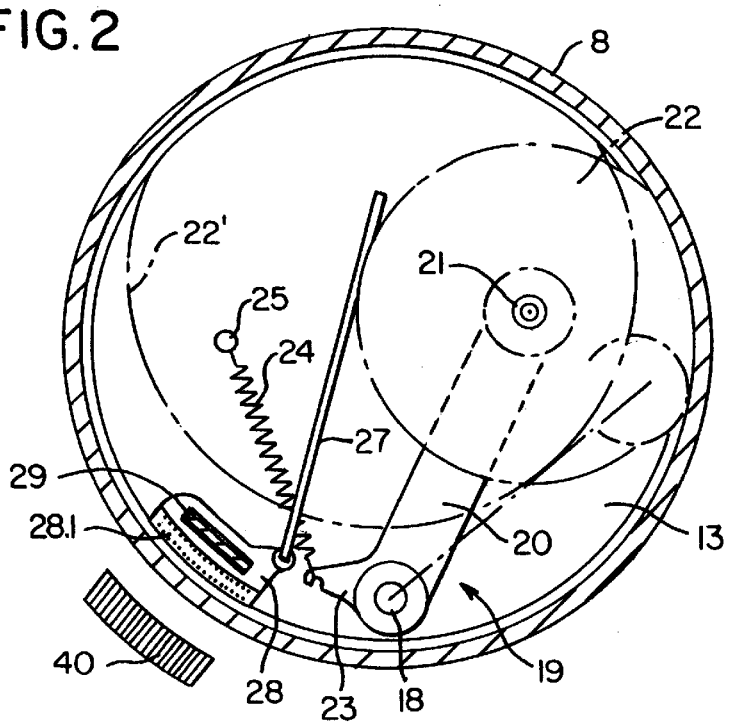
FIG. 2 shows schematically a section according to section line A-B of FIG. 1.
Figure 3:
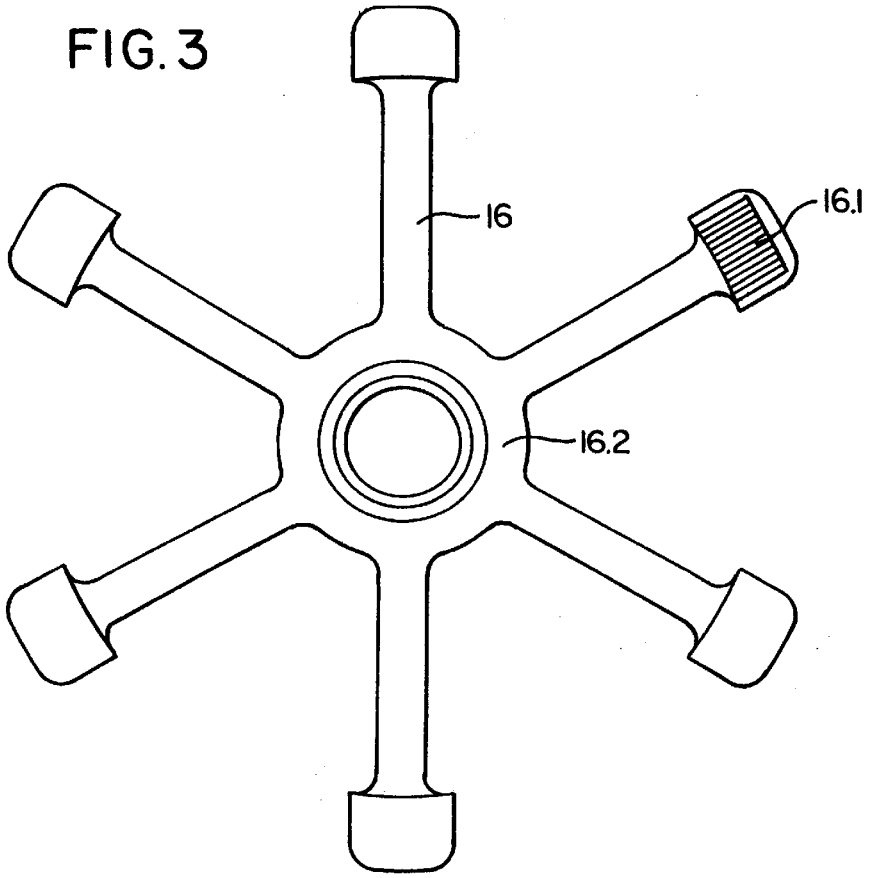
FIG. 3 show a schematic representation of the pole wheel of the driven protective pot with coordinated star wheel carrying magnets.

The two spun yarns a, a' which enter the lower end of the hollow axle 1, forming the first centering location, are guided radially outwardly through the yarn storage disc 3 and move in the form of a yarn balloon through the cylinder gap between the balloon limiter 7 and the protective pot 8 in the upward direction to the yarn guide eye 37 positioned coaxially to the spindle axis and forming a second centering location. From this centering location they exit downwardly into the interior of the double twisting device surrounded by the yarn balloon where they pass through the yarn guide 32 and along the guide roller 38 in order to be wound onto the winding bobbin 22. They are guided by the traversing yarn guide 27 so as to be collected as finished twisted yarn on the bobbin 22. The maximum diameter of the winding bobbin 22 is shown in FIG. 2 as a dash-dofted line 22'.

Figure 4:
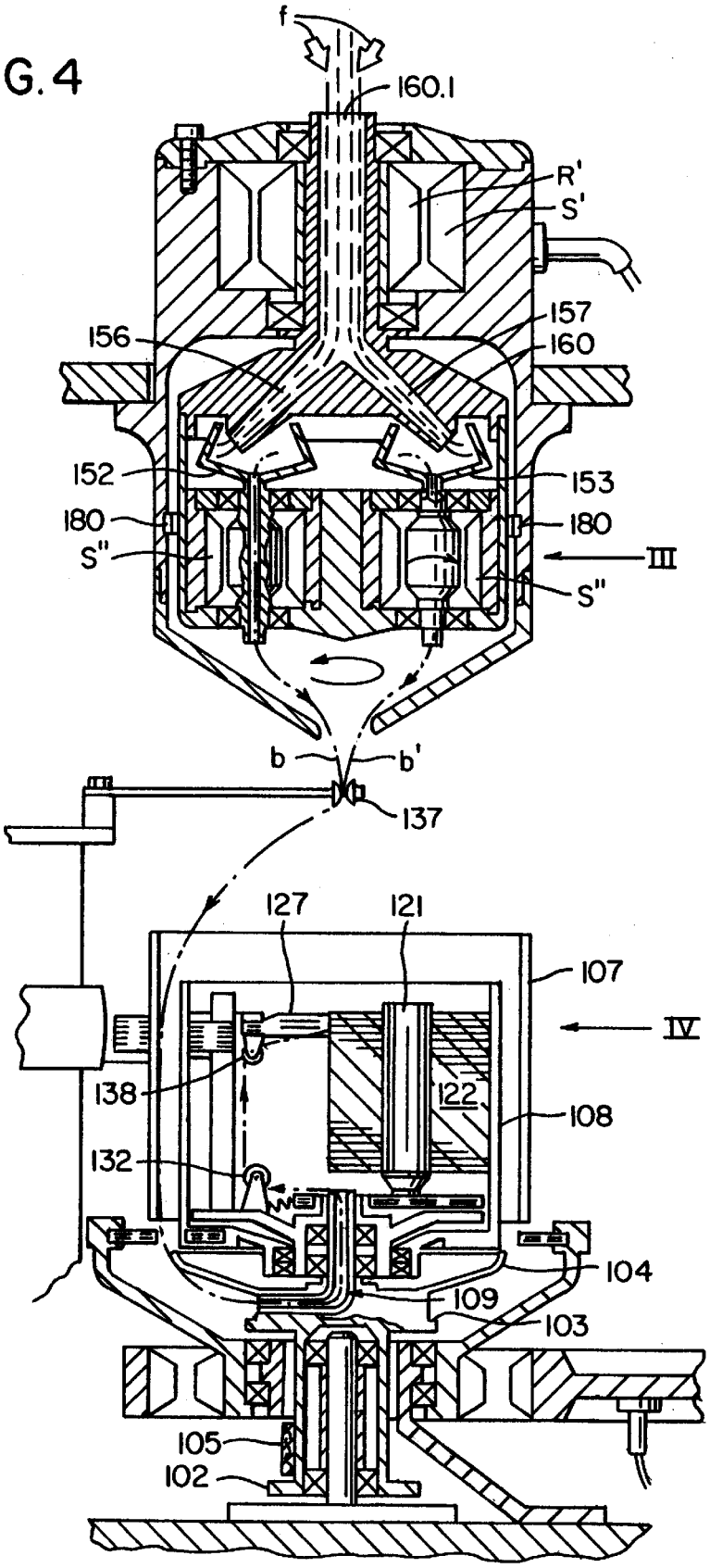
FIG. 4 shows a schematic representation, substantially in axial section, of a second embodiment of the inventive spinning and twisting device.

The embodiment according to FIG. 4 corresponds substantially to the embodiment according to FIG. 1 whereby the same reference numerals but in the hundred series are being used for identical parts, i.e., the reference numeral 108 of FIG. 4 corresponds to the reference numeral 8 of FIG. 1. According to FIG. 4 the spinning device III also comprises at least two adjacent spinning devices in the form of open end spinning rotors 152, 153 which are rotatably supported in a rotor 160 which can be rotatably driven by an electro-otonic drive comprised of the stator part S' and the rotor part R'. In connection with the downwardly arranged two-for-one twisting device of the twisting part IV an additional, i.e., third twisting can be imparted to the yarn.

The electro-motoric drive for the open end spinning rotor 152, 153 is realized by electric motors comprising the stator parts S" having oppositely arranged rotor parts. The energy supply can be provided in a conventional manner, for example, by slip ring arrangements 180. The fiber material supply according to arrow f through the rotor 160 is realized by providing a hollow axle section 160.1 with fiber material feed tubes 156, 157 connected thereto.

The spun yarns b, b' exiting the two open end spinning rotors are guided into a double twist device IV arranged down stream of the spinning device III. This double twist device (two-for-one twisting device) differs from the device according to FIG. 1 in that the first centering location where the two spun yarns b, b' are guided together, is formed by a guide eye 137 positioned coaxially to the spindle axis below the spinning device. The two combined spun yarns b, b' then are guided in the form of a yarn balloon through the gap between the balloon limiter 107 and the protective pot 108 and exit through the yarn guide channel of the yarn storage disc 103 radially inwardly into the spindle rotor which, in addition to the yarn storage disc 103, also comprises the overflow plate 104 and the whorl 102 driven by a tangential drive belt 105. The transition between the radially extending yarn guide channel of the yarn storage disc 103 and the hollow axle 109 extending axially therefrom defines the second centering location.

The yarn exiting from the yarn inlet tube 109 that corresponds to the hollow spindle axle is guided via guide rollers 132 and 138 to the traversing yarn guide 127, which is driven in the same manner as disclosed in FIG. 1 for the first variant of the inventive spinning and twisting device. The yarn winding bobbin 122 is supported in the same manner as disclosed in connection with FIG. 1.

The spinning and twisting device according to FIG. 4 can also be operated as a simple two-for-one variant according to FIG. 1 when the rotor 160 is eliminated.

The specification incorporates by reference the disclosure of German priority document 97 104 482.1-1256 of Mar. 15, 1997.

The present invention is, of course, in no way restricted to the specific disclosure of the specification and drawings, but also encompasses any modifications within the scope of the appended

What is claimed is:

1. A method for manufacturing a twisted yarn by a combined spinning and twisting process; said method comprising the steps of:

a) supporting at least two open end spinning rotors in a common rotor having a hollow feed axle;

b) feeding fiber material to be spun through said hollow feed axle and feed tubes connected to the hollow feed axle into said at least two open end spinning rotors and producing in said at least two open end spinning rotors individual spun yarns;

c) guiding the spun yarns together to a first centering location positioned coaxially to an axis of a double twisting device above the double twisting machine and below the at least two open end spinning rotors to subject the individual spun yarns in a first yarn feeding direction to a first twist, whereby a yarn balloon is formed;

d) subsequently guiding the spun yarns to a second centering location, positioned coaxially to the axis of the double twisting device below said first centering location, and through said second centering location into an interior of the yarn balloon to subject the spun yarns in a second yarn feeding direction, opposite said first yarn feeding direction, to a second twist;

e) winding the spun yarns onto a rotating bobbin positioned in the interior of the yarn balloon.

2. A method according to claim 1, wherein:

said step c) includes passing said spun yarns through a yarn guide eye forming said first centering location, wherein said spun yarns leave the yarn guide eye in a downward direction and form the yarn balloon rotating about the double twisting device; and wherein said step d) includes passing said spun yarns radially inwardly into a yarn storage disc of a spindle rotor and, in said second feeding direction, into the hollow axle of the spindle rotor forming said second centering location.

* * * * *